US006702289B1

(12) United States Patent
Feola

(10) Patent No.: US 6,702,289 B1
(45) Date of Patent: Mar. 9, 2004

(54) PAI GOW POKER-TYPE CARD GAME OF CHANCE USING A RANDOM NUMBER GENERATOR WITH A SIDE BET

(75) Inventor: John Feola, Medford, MA (US)

(73) Assignee: New Vision Gaming and Development, Inc., Medford, MA (US)

( * ) Notice: Subject to any disclaimer, the term of this patent is extended or adjusted under 35 U.S.C. 154(b) by 0 days.

(21) Appl. No.: 10/266,223

(22) Filed: Oct. 8, 2002

(51) Int. Cl.[7] ..... A63F 1/00
(52) U.S. Cl. ..... 273/274; 273/292
(58) Field of Search ..... 273/292, 274, 273/303, 309, 138.1, 236; 463/13

(56) References Cited

U.S. PATENT DOCUMENTS 5,863,041 A * 1/1999 Boylan et al. ..... 273/292
6,135,453 A * 10/2000 Srichayaporn ..... 273/292
6,443,455 B1 * 9/2002 Webb ..... 273/274
6,491,302 B1 * 12/2002 Boylan et al. ..... 273/292
6,631,906 B1 * 10/2003 Timpano ..... 273/292

* cited by examiner

*Primary Examiner*—Jacob K. Ackun
(74) *Attorney, Agent, or Firm*—Altman & Martin

(57) ABSTRACT

A method for playing a Pai Gow-type poker game where a random number generator is used to determine the first player or dealer position to receive a hand. Each player may place a side bet on which position is first to receive a hand.

3 Claims, 6 Drawing Sheets

PAI GOW POKER-TYPE CARD GAME OF CHANCE USING A RANDOM NUMBER GENERATOR WITH A SIDE BET

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to poker games, more particularly, to a form of Pai Gow poker that includes bonus hands.

2. Description of the Related Art

A very popular casino card game is Pai Gow poker. A player is dealt seven cards which she then arranges to make two hands: a two-card hand (low hand) and a five-card hand (high hand). Rankings are based on basic poker rankings. Thus, the highest two-card hand is two aces, and the highest five-card hand is a royal flush. When arranging the cards into the two-card and five-card hands, it is important to remember that the five-card hand must be ranked higher than the two-card hand. The object is for the player's two-card hand to rank higher than the dealer's two-card hand and for the player's five-card hand to rank higher than the dealer's five-card hand. The dealer wins all tied hands. If the player wins one hand and loses the other hand, a "push" results and no money exchanges hands. If the player wins both hands, she is paid even money, less a commission of typically 5%. If the player loses both hands, she loses the money wagered.

To start the game, the dealer deals out seven hands of seven cards each. Then the hands are placed in player or dealer positions depending upon the result of a random number generator. In some gaming establishments, the random number generator is a set of three dice, where the sum of the dice determines the position to receive the first hand. In other establishments, the random number generator is a digital electronic device built into the table that displays a number 1 through 7, which determines the position to receive the first hand. The remainder of the hands are placed in the remainder of the player and dealer positions in a clockwise direction. Each player then arranges his cards into a two-card low and a five-card high hand as described above. The house dealer does not look at the cards until all players have set their hands in the designated table spaces face down. The dealer then turns his cards over and sets his hands in front of the tray face up. The arrangement of cards into the two-card and five-card by which the dealer sets his hands are determined by rules of the gaming establishment. Finally, the player's hands are compared to the dealer's hand to determine the winners, losers, and ties.

There are two reasons why gaming establishments do not prefer Pai Gow poker. Not coincidentally, they are also reasons why the game is popular. The first is that, because of the number of steps involved, the game is rather slow: (1) the cards are dealt, (2) the first position to receive a hand is determined, (3) the hands are placed, (4) the players set their hands, (5) the dealer sets his hand, and, finally, (6) the hands are compared and the winners are determined. The second reason that gaming establishments are not fond of Pai Gow poker is that not every game wins or loses. A significant percentage of the time, a hand ends in a push, where no money changes hands, reducing the establishment's chance of winning.

BRIEF SUMMARY OF THE INVENTION

An object of the present invention is to provide a Pai Gow poker game that provides a player more opportunities for winning than standard Pai Gow poker.

Another object is to provide a Pai Gow poker game that provides greater odds for the gaming establishment while retaining the aspects of the game that players like.

Another object is to provide a Pai Gow poker game that moves faster than standard Pai Gow poker.

The basic game of the present invention is a variation on standard Pai Gow poker with the inclusion of bonuses on partial hands. Another aspect is a Pai Gow-like poker game that is played with fewer than the standard seven cards. A third aspect is the inclusion of a side bet based on the random number generator used to determine which position receives the first hand.

The present specification describes five sample games: (1) a seven-card game with three-card and five-card bonus phases, a seven-card Pai Gow phase, and an optional seven-card bonus phase; (2) a seven-card game with a three-card bonus phase, a seven-card Pai Gow phase, and an optional seven-card bonus phase; (3) a five-card game without bonuses; (4) a five-card game with a three-card bonus phase, a five-card Pai Gow phase, and an optional five-card bonus phase; and (5) a seven-card game with three-card and five-card bonus phases, three-card, five-card, and seven-card Pai Gow phases, and an optional seven-card bonus phase.

The basic method of the present invention, that of example games 1, 2, 4 and 5, is a method for playing a card game between a banker and at least one player, where the game includes a Pai Gow phase using a total number of cards and at least one bonus phase using a bonus number of cards fewer than the total number. The game provides for the player to place a wager on the bonus outcome and the Pai Gow outcome and for a bonus payout schedule. Cards are dealt to each player and dealer to form a partial hand. The player's partial hand is compared to the bonus payout schedule and appropriate payouts are made to the player. Then cards are dealt to each player and dealer until each hand has a total number of cards. The player and dealer divide their hands into low and high hands, then the player's and dealer's hands are compared, and appropriate payouts are made.

Another basic method of the present invention, that of example game 3, is a method for playing a card game between a banker and at least one player, where the game provides for the player to place a wager on the outcome. Cards are dealt to each player and dealer to form a hand of less than seven cards. The player and dealer divide their hands into low and high hands, then the player's and dealer's hands are compared, and appropriate payouts are made.

A third basic method of the present invention includes providing a side bet based on the result of a random number generator that is used to determine the first position to received cards during the deal of a Pai Gow game.

The present invention contemplates that the game may be played on a variety of media, including regular paper playing cards at a table and electronic media, such as video machines at gaming establishments, standalone personal computers, personal computers on a network, and personal digital assistants (PDAs).

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
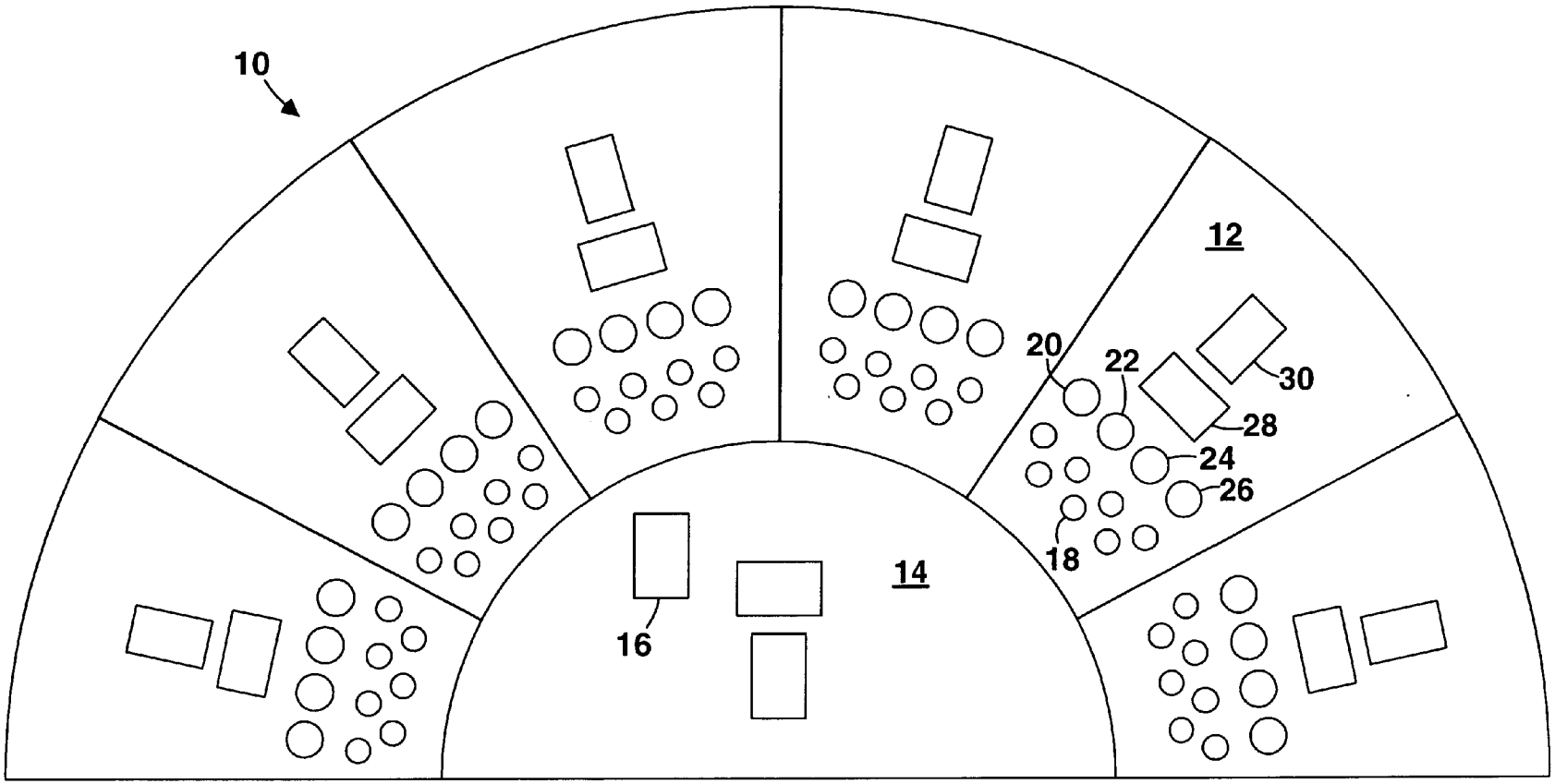
FIG. 1 is a drawing of an example table layout of a seven-card game with two bonuses of the present invention.

The basic game of the present invention is a variation on standard Pai Gow poker with the inclusion of bonuses that may be won during the play of a game. The bonuses are based on partial hands received during the course of the game. For example, a bonus may be based on the first three cards dealt to the player and/or on the first five cards dealt to the player. Another aspect of the present invention is a Pai Gow-like poker game that is played with fewer than the standard seven cards, for example, five cards divided into a two-card low hand and a three-card high hand. A third aspect of the present invention is the inclusion of a side bet based on the random number generator used in standard Pai Gow poker to determine which player or dealer position receives the first hand.

A. Game Background

The term "card" is used in the present application to indicate a playing card or any facsimile thereof. For example, a card can be a paper playing card or an image of a card on a video display or ticket. Any representation of a playing card is contemplated. In addition, each card has a value which, for the standard poker decks of 52 cards, includes the suit (hearts, diamonds, clubs, spades) and the number (2–10, J, Q, K, A). Finally, the general rules of Pai Gow poker include the use of a $53^{rd}$ card, a joker, that can be used to complete a straight, to complete a flush, or as an ace. In the present invention, the use of a joker or any other wild card is optional.

As described below, winning hands are typically determined by standard Pai Gow poker rankings. Standard Pai Gow poker rankings are the same as standard poker rankings, with the exception that the second highest straight is A-2-3-4-5. The use of standard Pai Gow rankings is merely a convenience, and are used primarily because most people know the rankings and know, for example, that it is more difficult to get a straight than to get a pair. However, the present invention contemplates that some standard card combination may be excluded and that other card combinations may be used to determine winning hands. For example, straights and flushes may be excluded from the hand rankings. Examples of combinations that may be included in ranking are hands of all even numbered cards, hands with at least one card from each suit, and/or pairs of like-colored cards. Unless otherwise indicated, the examples in the remainder of the specification will use standard Pai Gow poker rankings.

Standard Pai Gow rules require that the two-card hand have a rank that is equal to or lower than the rank of the five-card hand. The present invention contemplates that the reverse may also be true, that the two-card hand is equal to or higher in rank that that of the five-card hand.

Pai Gow may be played with a banker other than the gaming establishment, which means that the dealer does not necessarily represent the banker. The present invention contemplates that such an option is available. The remainder of the specification uses the term, "dealer", to denote the person dealing the cards and the term, "banker", to denote the person or entity having the hand against which the players' hands are compared. It is possible, and generally likely, that the dealer and banker will be the same.

Winning bonus hands of the present invention are generally paid as a multiple of the amount wagered. However, it is also contemplated that a bonus may be paid as a percentage of a jackpot that is "set" or "progressive". In a set jackpot, the amount put into the jackpot for each game is fixed, but the fixed amount may be adjusted periodically, for example, after the jackpot is won. In a progressive jackpot, the amount put into the jackpot increases for each game played during which the jackpot is not won.

Finally, non-monetary winnings, such as toys, gifts, or coupons, are possible. It is also contemplated that the game may be played for fun rather than for monetary gain.

B. Game Play

The present specification employs five sample games to describe the present invention. The first game is a seven-card game with a three-card bonus phase, a five-card bonus phase, a seven-card Pai Gow phase, and an optional seven-card bonus phase. The second game is a seven-card game with a three-card bonus phase, a seven-card Pai Gow phase, and an optional seven-card bonus phase. The third game is a five-card game without bonuses. The fourth game is a five-card game with a three-card bonus phase, a five-card Pai Gow phase, and an optional five-card bonus phase. The fifth game is a seven-card game with a three-card bonus phase, a three-card Pai Gow phase, a five-card bonus phase, a five-card Pai Gow phase, a seven-card Pai Gow phase, and an optional seven-card bonus phase. It is understood that present invention is not limited to Pai Gow hands of five cards or seven cards. It is also understood that the present invention is not limited to bonuses of three and/or five cards. The bonus hand or hands may have any number of cards up to and including all cards in the hand. For example, bonuses may be available on two and four card hands, rather than on three and five cards hands. The present invention also contemplates that the Pai Gow hand may be divided into two hands where the low hand does not have two cards. For example, the seven-card game may have a three-card low hand and a four-card high hand.

Before game play begins, the house determines the exact rules of the game, including such items as how many cards are in a hand, how many cards are in the low and high hands, how many and what combination of cards are available for bonuses, the amounts that can be wagered, the payout schedule, the rules used by the banker for setting the hands, whether cards are dealt face up or face down, the percentage, if any, taken by the house or banker on winning hands, and any other rules necessary to playing the game. For the following examples, standard Pai Gow poker rules are assumed, except where otherwise noted.

1. Seven-Card Game with Two Bonuses

The example seven-card game begins with each player having the option to wager on the three-card bonus phase, the five-card bonus phase, the Pai Gow phase, and/or the optional seven-card bonus phase, if desired. As shown in FIG. 1, the gaming table 10 includes a position 12 for each player and a position 14 for the dealer. Wagering for the three-card bonus phase is done by placing a wager of the desired amount in the three-card spot 20, wagering for the five-card bonus phase is done by placing a wager of the desired amount in the five-card spot 22, wagering for the Pai Gow phase is done by placing a wager of the desired amount in the Pai Gow spot 26, and wagering for the optional seven-card bonus phase is done by placing a wager of the desired amount in the seven-card spot 24. Each wager is optional, but at least one must be made, otherwise the player does not participate in that particular game.

After wagers are made, the dealer deals out three cards to each player position 12 to form a three-card partial hand and to the dealer's position 14 to form a three-card partial hand. As indicated above, standard Pai Gow rules call for the use of a random number generator 16 to determine the first position to receive cards. Typically, the random number generator 16 is a set of three dice or a digital electronic device. In the present invention, the use of a random number generator 16 is optional. If it is used, there are two possibilities as to when the resulting random number is employed. In the first, the three-card hands are dealt out first and then placed according to the random number generator 16. The random number generator 16 determines the first position to receive a hand and the remainder of the positions receive hands in a clockwise direction from the first position. In the second, the random number generator 16 determines the first position to receive the cards and then the three-card hands are dealt to each position, starting with the first position and continuing clockwise. If a random number generator 16 is not used, the dealer may start with whatever position is dictated by the game rules. Typically, the deal will start at the position to the dealer left and continue clockwise.

The present invention contemplates that the outcome of the random number generator 16, that is, the number of the position to receive the first hand, can be the subject of a side bet. For example, each player position 12 on the table layout 10 may include seven spots 18, one for each player position 12 and the dealer position 14. The player wagers on the number of the position to receive the first hand by placing a wager in one or more of these spots 18. Obviously, the wagering must be done sometime before the random number generator 16 indicates a position. If the player wagers correctly, she wins an amount that is a multiple of her wager. Since the odds of winning such a wager are one in seven for each spot, the payout may be, for example, five to one, so that the banker has better than even odds of coming out ahead in the long run.

After the first three cards are dealt to each position, each player that wagered on the three-card bonus phase determines if she is entitled to a three-card bonus by comparing the three-card partial hand to a three-card bonus payout schedule, an example of which is shown in Table I. If the player believes she is entitled to a bonus, she places her cards face up on the table. If the dealer or banker agrees that the player is entitled to a bonus, the player is paid the appropriate amount based on the three-card payout schedule.

TABLE I

| Hand | X Amount |
|---|---|
| Straight Flush | 40 |
| Three of a Kind | 30 |
| Straight | 6 |
| Flush | 4 |
| Pair | 1 |

After all players that have wagered on the three-card bonus phase have been settled, the dealer deals out two more cards to each player position 12 to combine with the three-card partial hand to form a five-card partial hand and to the dealer position 14 to combine with the three-card partial hand to form a five-card partial hand. Now each player that wagered on the five-card bonus phase determines if she is entitled to a five-card bonus by comparing her five-card partial hand to a five-card bonus payout schedule, an example of which is shown in Table II. If the player believes she is entitled to a bonus, she places her cards face up on the table. If the dealer or banker agrees that the player is entitled to a bonus, the player is paid the appropriate amount based on the five-card payout schedule.

TABLE II

| Hand | X Amount |
|---|---|
| Royal Flush | 1000 |
| Straight Flush | 200 |
| Four of a Kind | 100 |
| Full House | 25 |
| Straight | 8 |
| Three of a Kind | 5 |
| Two Pair | 2 |

After all players that have wagered on the five-card bonus phase have been settled, the dealer deals out two more cards to each player position 12 to combine with the five-card bonus hand to form a seven-card Pai-Gow hand and to the dealer position 14 to combine with the five-card partial hand to form a seven-card Pai Gow hand. From this point, the Pai Gow phase is typically played like standard Pai Gow poker. Each player divides her cards into a two-card low hand and a five-card high hand. The low hand is placed in the appropriate spot 28 at the player's position 12 and the high hand is placed in the appropriate spot 30 at the player's position 12. The banker then sets his cards appropriately into a two-card low hand and a five-card high hand. The player's hands are then compared to the banker's hands to determine if the total game is a win, loss, or push. For a win, the player receives the same amount as her wager, minus 5% for the house or banker. For a loss, the player loses her wager. For a push, no money is exchanged. Alternatively, the present invention contemplates that the player's complete seven-card hand can be compared to the banker's complete seven-card hand to determine a winner if there is a push.

Optionally, a seven-card bonus phase is offered. The dealer or banker determines if any player that wagered on the seven-card bonus phase is entitled to a seven-card bonus by comparing the seven-card hand to a seven-card bonus payout schedule. If the player is entitled to a bonus, the player is paid the appropriate amount based on the seven-card payout schedule. The seven-card payout schedule can include such items as the best five cards out of the seven, seven card straights and flushes, all cards of one color, etc.

2. Seven-Card Game with One Bonus

Figure 2:
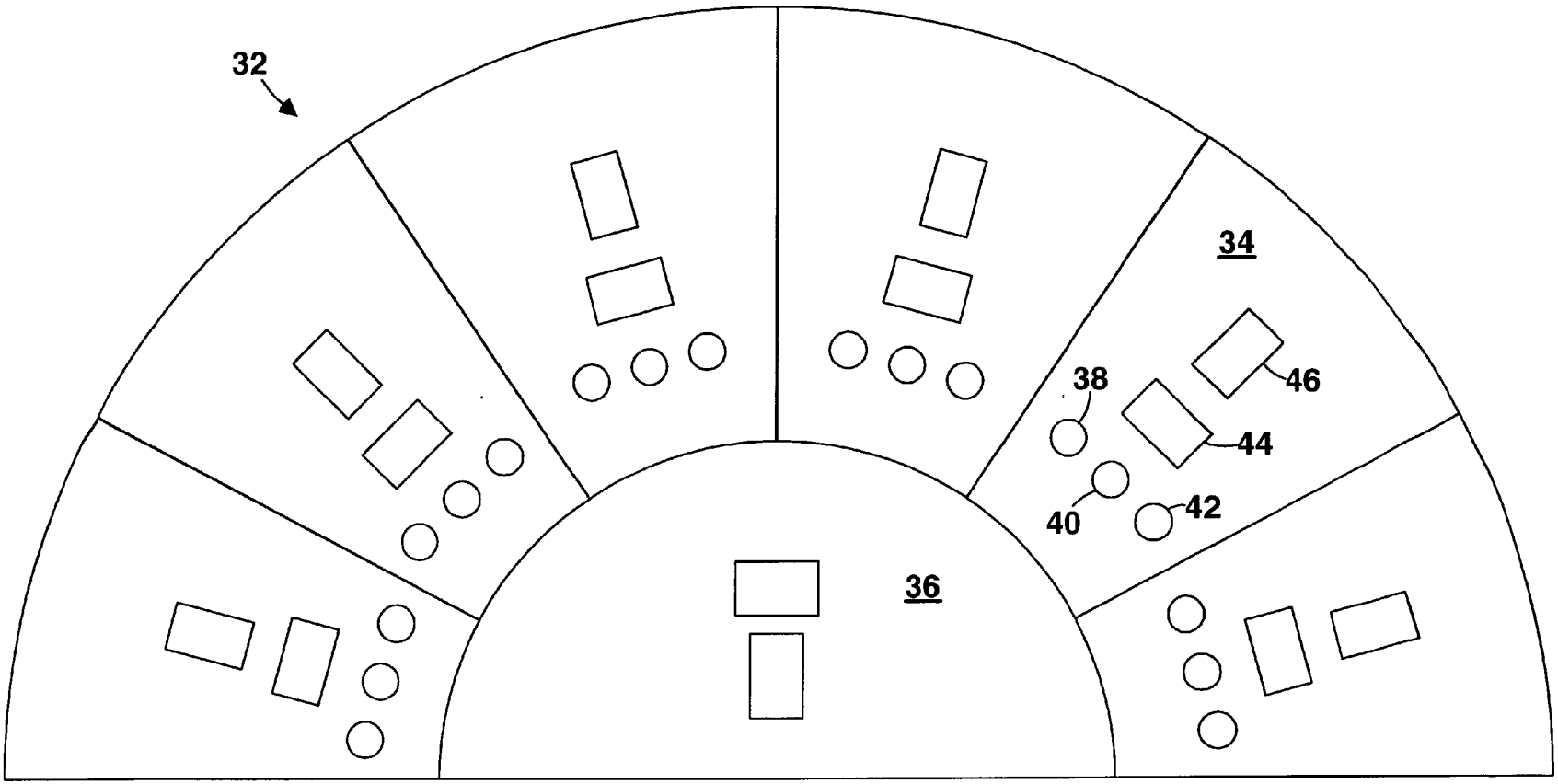
FIG. 2 is a drawing of an example table layout of a seven-card game with one bonus of the present invention.

The example seven-card game begins with each player having the option to wager on the three-card bonus phase, the Pai Gow phase, and/or the optional 7-card bonus phase, if desired. As shown in FIG. 2, the gaming table 32 includes a position 34 for each player and a position 36 for the dealer. Wagering for the three-card bonus phase is done by placing a wager of the desired amount in the three-card spot 38, wagering for the Pai Gow phase is done by placing a wager of the desired amount in the Pai Gow spot 42, and wagering for the optional five-card bonus phase is done by placing a wager of the desired amount in the five-card spot 40. Each wager is optional, but at least one must be made, otherwise the player does not participate in that particular game.

After wagers are made, the dealer deals out three cards to each player's position 34 to form a three-card partial hand and the dealer's position 36 to form a three-card partial hand. As described above with respect to the seven-card game, a random number generator may be used to determine the first position to receive a hand.

After the first three cards are dealt to each position, each player that wagered on the three-card bonus phase determines if she is entitled to a three-card bonus by comparing her three-card partial hand to a three-card bonus payout schedule. If the player believes she is entitled to a bonus, she places her cards face up on the table. If the dealer or banker agrees that the player is entitled to a bonus, the player is paid the appropriate amount based on the three-card payout schedule.

After all players that have wagered on the three-card bonus phase have been settled, the dealer deals out four more cards to each player position 34 to combine with the three-card partial hand to form a seven-card Pai Gow hand and to the dealer position 36 to combine with the three-card partial hand to form a seven-card Pai Gow hand. Each player divides her seven cards into a two-card low hand and a five-card high hand. The rank of the low hand cannot exceed the rank of the high hand. The low hand is placed in the appropriate spot 44 at the player's position 34 and the high hand is placed in the appropriate spot 46 at the player's position 34. The banker then sets his cards appropriately into a two-card low hand and a five-card high hand. The player's hands are then compared to the banker's hands to determine if there is a win, loss, or push. For a win, the player receives the same amount as her wager, minus 5% for the house or banker. For a loss, the player loses her wager. For a push, no money is exchanged. Alternatively, the present invention contemplates that the player's complete seven-card hand can be compared to the banker's complete seven-card hand to determine a winner if there is a push.

Optionally, a seven-card bonus phase is offered. The dealer or banker determines if any player that wagered on the seven-card bonus phase is entitled to a seven-card bonus by comparing the seven-card hand to a seven-card bonus payout schedule. If the player is entitled to a bonus, the player is paid the appropriate amount based on the seven-card payout schedule. The seven-card payout schedule can include such items as the best five cards out of the seven, seven card straights and flushes, all cards of one color, etc.

3. Five-Card Game without Bonus

Figure 3:
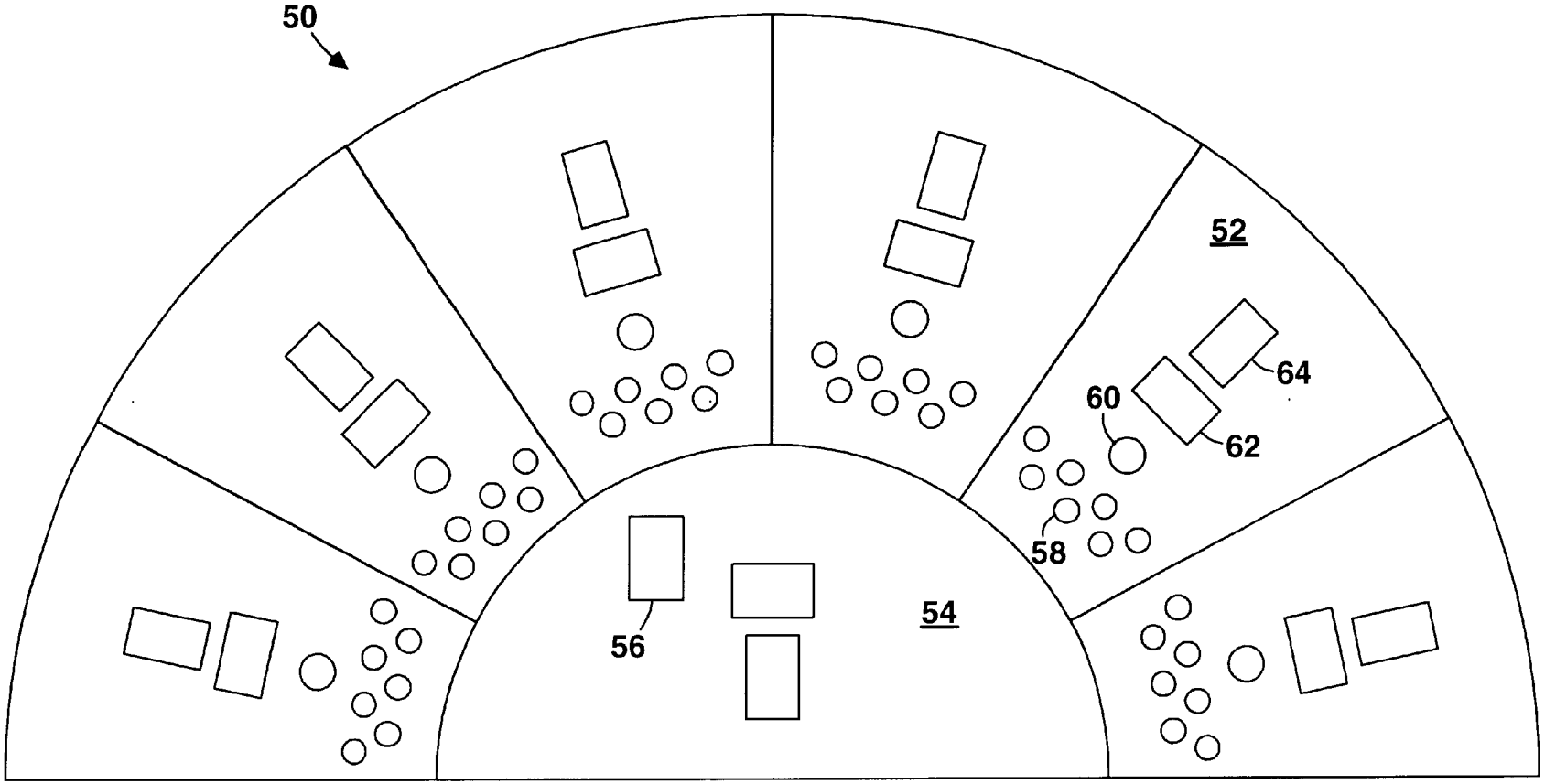
FIG. 3 is a drawing of an example table layout of a five-card game without bonuses of the present invention.

The example five-card game without bonus begins with each player wagering on the outcome of the game. As shown in FIG. 3, the gaming table 50 includes a position 52 for each player and a position 54 for the dealer. Wagering is done by placing a wager of the desired amount in the appropriate spot 60 at the player's position.

After wagers are made, the dealer deals out five cards to each player position 52 and the dealer's position 54. As described above with respect to the seven-card game, a random number generator 56 may be used to determine the first position to receive a hand. As described above, the players may also wager on the outcome of the random number generator 56 by placing wagers in the appropriate spots 58.

Each player divides her total number of cards into a two-card low hand and a three-card high hand. The rank of the low hand cannot exceed the rank of the high hand. The low hand is placed in the appropriate spot 62 in the player's position 52 and the high hand is placed in the appropriate spot 64 in the player's position 52. The banker then sets his total number of cards appropriately into a two-card low hand and a three-card high hand. The player's hands are then compared to the banker's hands to determine if there is a win, loss, or push. For a win, the player receives the same amount as her wager, minus 5% for the house or banker. For a loss, the player loses her wager. For a push, no money is exchanged. Alternatively, the present invention contemplates that the player's total five-card hand can be compared to the banker's total five-card hand to determine a winner if there is a push.

4. Five-Card Game with Bonus

Figure 4:
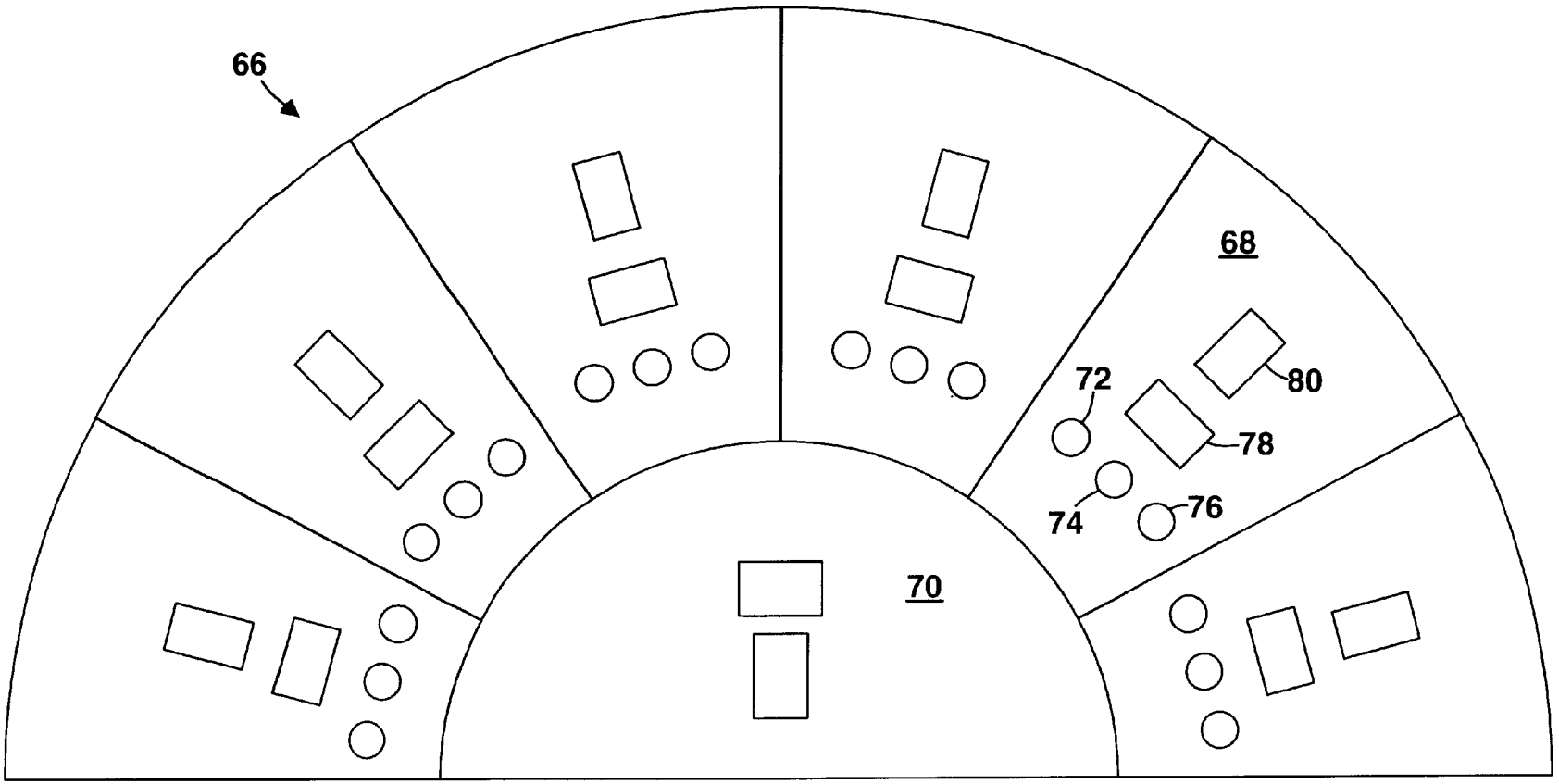
FIG. 4 is a drawing of an example table layout of a five-card game with bonus of the present invention.

The example five-card game begins with each player having the option to wager on the three-card bonus phase, the Pai Gow phase, and/or the optional 5-card bonus phase, if desired. As shown in FIG. 4, the gaming table 66 includes a position 68 for each player and a position 70 for the dealer. Wagering for the three-card bonus phase is done by placing a wager of the desired amount in the three-card spot 72, wagering for the Pai Gow phase is done by placing a wager of the desired amount in the Pai Gow spot 76, and wagering for the optional five-card bonus phase is done by placing a wager of the desired amount in the five-card spot 74. Each wager is optional, but at least one must be made, otherwise the player does not participate in that particular game.

After wagers are made, the dealer deals out three cards to each player's position 68 to form a three-card partial hand and the dealer's position 70 to form a three-card partial hand. As described above with respect to the seven-card game, a random number generator may be used to determine the first position to receive a hand.

After the first three cards are dealt to each position, each player that wagered on the three-card bonus phase determines if she is entitled to a three-card bonus by comparing her three-card partial hand to a three-card bonus payout schedule. If the player believes she is entitled to a bonus, she places her cards face up on the table. If the dealer or banker agrees that the player is entitled to a bonus, the player is paid the appropriate amount based on the three-card payout schedule.

After all players that have wagered on the three-card bonus phase have been settled, the dealer deals out two more cards to each player position 68 to combine with the three-card partial hand to form a five-card Pai Gow hand and to the dealer position 70 to combine with the three-card partial hand to form a five-card Pai Gow hand. Each player divides her cards into a two-card low hand and a three-card high hand. The rank of the low hand cannot exceed the rank of the high hand. The low hand is placed in the appropriate spot 78 at the player's position 68 and the high hand is placed in the appropriate spot 80 at the player's position 68. The banker then sets his cards appropriately into a two-card low hand and a three-card high hand. The player's hands are then compared to the banker's hands to determine if there is a win, loss, or push. For a win, the player receives the same amount as her wager, minus 5% for the house or banker. For a loss, the player loses her wager. For a push, no money is exchanged. Alternatively, the present invention contemplates that the player's complete five-card hand can be compared to the banker's complete five-card hand to determine a winner if there is a push.

Optionally, a five-card bonus phase is offered. The dealer or banker determines if any player that wagered on the five-card bonus phase is entitled to a seven-card bonus by comparing the five-card hand to a five-card bonus payout schedule. If the player is entitled to a bonus, the player is paid the appropriate amount based on the five-card payout schedule.

5. Seven-Card Combined Game

Figure 5:
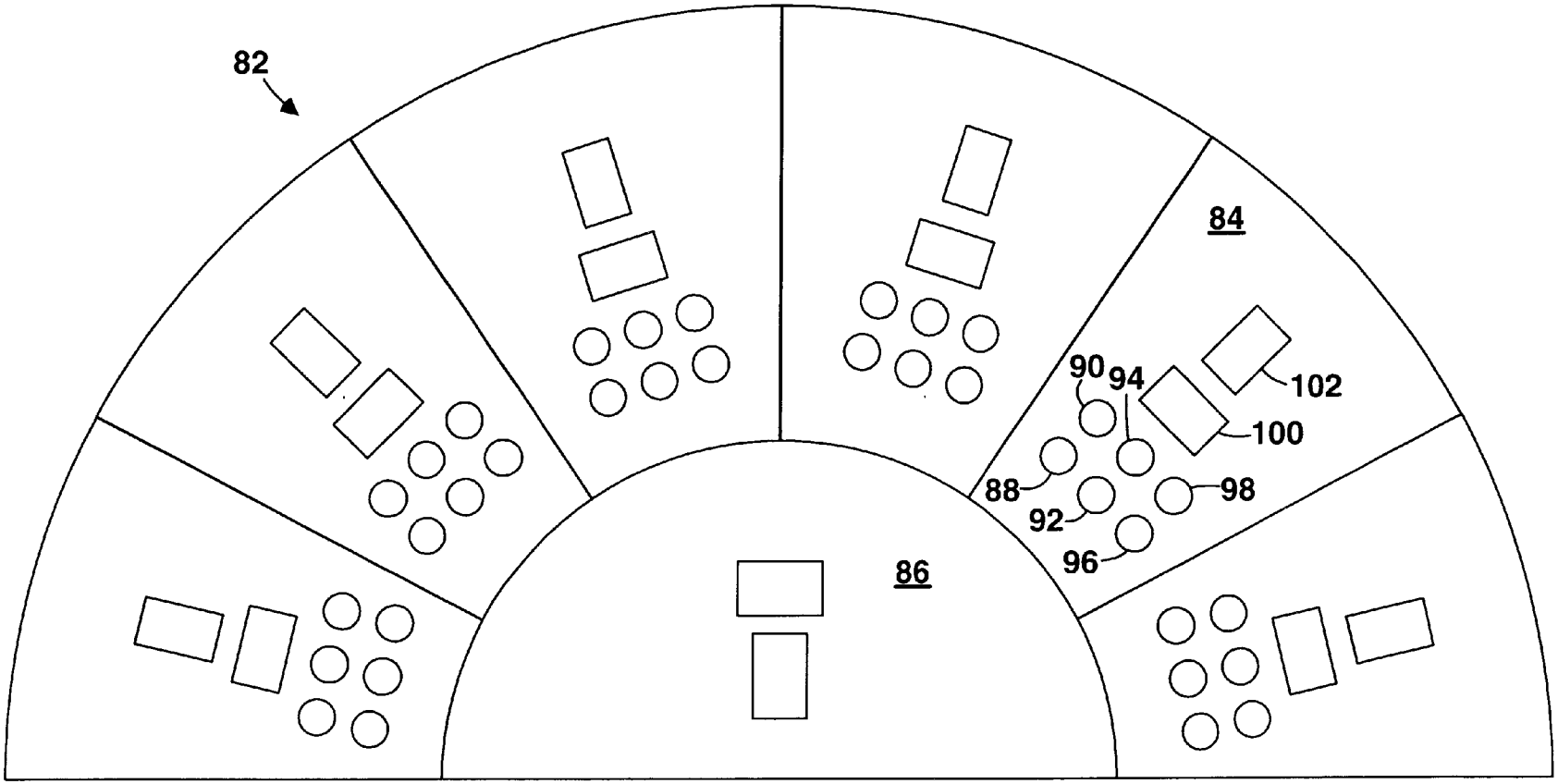
FIG. 5 is a drawing of an example table layout of a seven-card game with multiple Pai Gow hands and bonuses of the present invention.

The example seven-card combined game begins with each player having the option to wager on the three-card bonus phase, the three-card Pai Gow phase, the five-card bonus phase, the five-card Pai Gow phase, the seven-card Pai Gow phase, and/or the optional seven-card bonus phase, if desired. As shown in FIG. 5, the gaming table 82 includes a position 84 for each player and a position 86 for the dealer. Wagering for the three-card bonus phase is done by placing a wager of the desired amount in the three-card bonus spot 88, wagering for the three-card Pai Gow phase is done by placing a wager of the desired amount in the three-card Pai Gow spot 90, wagering for the five-card bonus phase is done by placing a wager of the desired amount in the five-card bonus spot 92, wagering for the five-card Pai Gow phase is done by placing a wager of the desired amount in the five-card Pai Gow spot 94, and wagering for the seven-card Pai Gow phase is done by placing a wager of the desired amount in the Pai Gow spot 98, and wagering for the optional seven-card bonus phase is done by placing a wager of the desired amount in the seven-card bonus spot 96. Each wager is optional, but at least one must be made, otherwise the player does not participate in that particular game.

After wagers are made, the dealer deals out three cards to each player position 84 to form a three-card partial hand and the dealer's position 86 to form a three-card partial hand. After the first three cards are dealt to each position, each player that wagered on the three-card bonus phase determines if she is entitled to a three-card bonus by comparing her three-card partial hand to a three-card bonus payout schedule. If the player believes she is entitled to a bonus, she places her cards face up on the table. If the dealer or banker agrees that the player is entitled to a bonus, the player is paid the appropriate amount based on the three-card payout schedule.

In the three-card Pai Gow phase, each player divides her three-card partial hand into a one-card low hand and a two-card high hand. The low hand is placed in the appropriate spot 100 at the player's position 84 and the high hand is placed in the appropriate spot 102 at the player's position 84. The banker then sets his cards appropriately into a one-card low hand and a two-card high hand. The player's hands are then compared to the banker's hands to determine if the total game is a win, loss, or push. For a win, the player receives the same amount as her wager, minus 5% for the house or banker. For a loss, the player loses her wager. For a push, no money is exchanged. Alternatively, the present invention contemplates that the player's complete three-card hand can be compared to the banker's complete three-card hand to determine a winner if there is a push.

After all players that have wagered on the three-card Pai Gow phase have been settled, the dealer deals out two more cards to each player position 84 to combine with the three-card partial hand to form a five-card partial hand and to the dealer position 86 to combine with the three-card partial hand to form a five-card partial hand. Now each player that wagered on the five-card bonus phase determines if she is entitled to a five-card bonus by comparing her five-card partial hand to a five-card bonus payout schedule. If the player believes she is entitled to a bonus, she places her cards face up on the table. If the dealer or banker agrees that the player is entitled to a bonus, the player is paid the appropriate amount based on the five-card payout schedule.

In the five-card Pai Gow phase, each player divides her five-card partial hand into a two-card low hand and a three-card high hand. The low hand is placed in the appropriate spot 100 at the player's position 84 and the high hand is placed in the appropriate spot 102 at the player's position 84. The banker then sets his cards appropriately into a two-card low hand and a three-card high hand. The player's hands are then compared to the banker's hands to determine if the total game is a win, loss, or push. For a win, the player receives the same amount as her wager, minus 5% for the house or banker. For a loss, the player loses her wager. For a push, no money is exchanged. Alternatively, the present invention contemplates that the player's complete seven-card hand can be compared to the banker's complete seven-card hand to determine a winner if there is a push.

After all players that have wagered on the five-card Pai Gow phase have been settled, the dealer deals out two more cards to each player position 84 to combine with the five-card partial hand to form a seven-card Pai Gow hand and to the dealer position 86 to combine with the five-card partial hand to form a seven-card Pai Gow hand. Each player divides her seven cards into a two-card low hand and a five-card high hand. The low hand is placed in the appropriate spot 100 at the player's position 84 and the high hand is placed in the appropriate spot 102 at the player's position 84. The banker then sets his cards appropriately into a two-card low hand and a five-card high hand. The player's hands are then compared to the banker's hands to determine if there is a win, loss, or push. For a win, the player receives the same amount as her wager, minus 5% for the house or banker. For a loss, the player loses her wager. For a push, no money is exchanged. Alternatively, the present invention contemplates that the player's complete seven-card hand can be compared to the banker's complete seven-card hand to determine a winner if there is a push.

Optionally, a seven-card bonus phase is offered. The dealer or banker determines if any player that wagered on the seven-card bonus phase is entitled to a seven-card bonus by comparing the seven-card hand to a seven-card bonus payout schedule. If the player is entitled to a bonus, the player is paid the appropriate amount based on the seven-card payout schedule. The seven-card payout schedule can include such items as the best five cards out of the seven, seven card straights and flushes, all cards of one color, etc.

C. Playing Media

As indicated above, the present invention contemplates that the game may be played on a variety of media, including the use of regular paper playing cards at a table in a gaming establishment and the use of electronic media, the former being described above.

Figure 6:
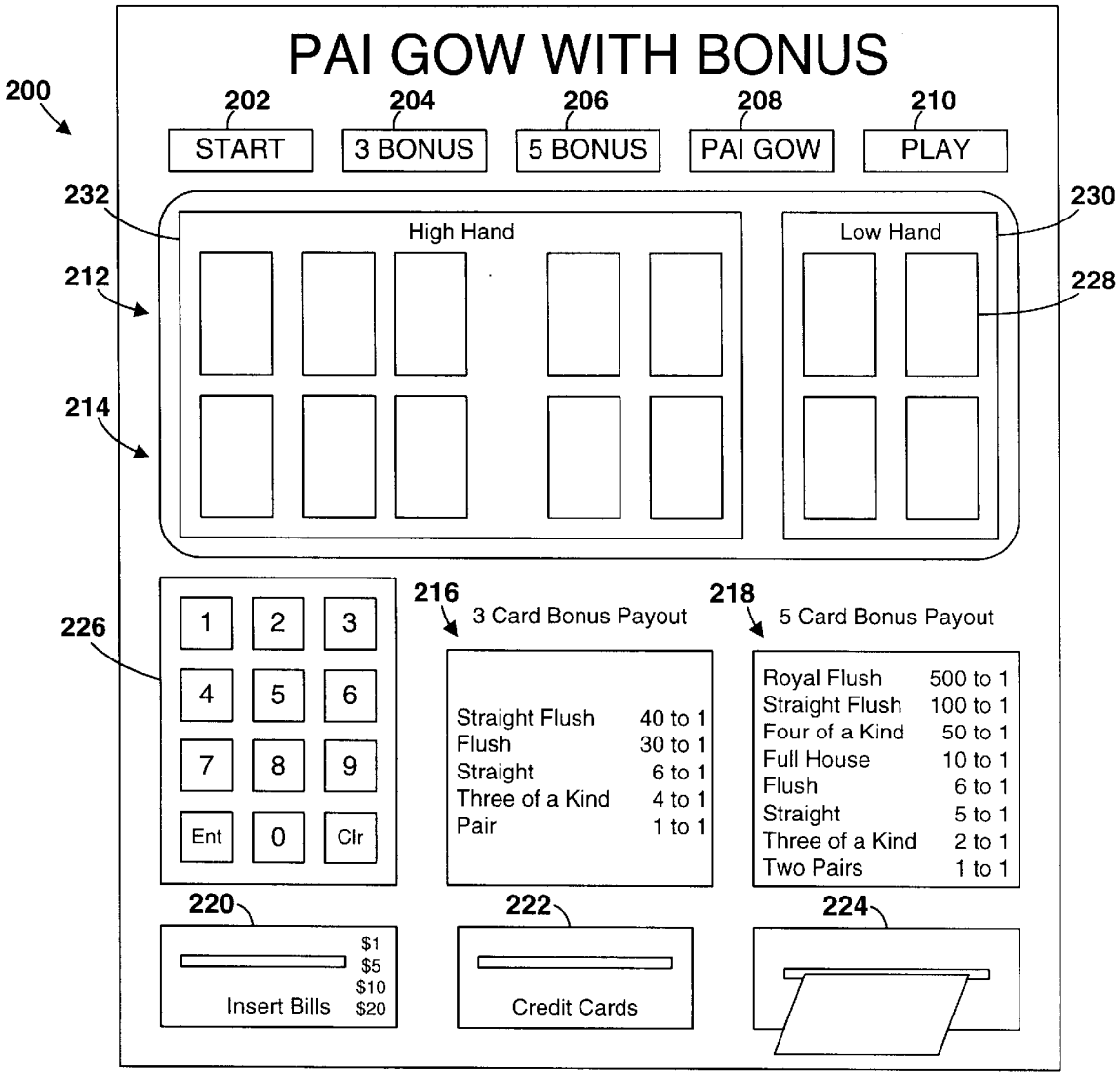
FIG. 6 is a drawing of an example machine for playing the seven-card game with bonuses of the present invention.

Electronic media includes standalone machines and machines on networks. With a standalone machine, each player has her own terminal 200. An example is a video machine at a gaming establishment, as shown in FIG. 6, for playing the seven-card game described above. Other examples include personal computers, personal digital assistants (PDAs), etc. Prior to playing any game, the player inserts cash, tokens, or paper, tickets into a money reader 220, swipes a credit or debit card in a card reader 222, inputs a credit or debit card number, or any other way available on the machine to provide a cash or monetary equivalent. The player begins a game by pressing the START button 202. Next, the player is permitted to enter which bonuses and game, if any, she wants to play by pressing the appropriate buttons 204, 206, 208 and the amounts to wager in the keypad 226. Optionally, the wager amounts for each bonus and game are predetermined, for example, only a $5 bet is allowed for a bonus and only a $20 bet is allowed for the Pai Gow game.

After wagering is complete, the machine 200 deals three cards to the player row 212 for the three-card bonus, assuming it is being played. If the hand formed by these three cards creates a hand that is entitled to a bonus payout as indicated by the three-card bonus payout table 216, such a payout is made. Next, the machine 200 deals two more cards to the player row 214 for the five-card bonus, assuming it is being played. If the hand formed by these five cards creates a hand that is entitled to a bonus payout as indicated by the five-card bonus payout table 218, such a payout is made.

After the bonuses are complete, the machine deals the remaining two cards to the player row 212 and the player is allowed to set the two-card low hand and five-card high hand. There are any number of ways that this can be used to set the hands. For example, each card location 228 is numbered and the keypad is used to move cards to the low hand. Alternatively, the display is touch sensitive and the last two cards touched go into the low hand. The present invention contemplates that any way of selecting cards for each hand can be used. The low hand is displayed separately from the high hand, as at 230, 232.

After the hands are set, the player presses the PLAY button 210 to complete the game. The machine 200 displays a two-card low hand and a five-card high hand in the banker row 214 and then compares the hands. Winning amounts are credited to the player and may be printed on a voucher or paper ticket, as at 224, paid in coins or other monetary tokens by the machine itself, or credited to the player's credit or debit card. Losing amounts are deducted from the player's account.

The present invention also contemplates that the machine may be a component of a network wherein one machine is operated by the banker and other machines are operated by the players.

The above-described machines are merely examples of machines that can be used to implement the present invention. Any machine that can offer the game using the rules described above is contemplated by the present invention.

Thus it has been shown and described a card game which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method for playing a Pai Gow poker game between a banker and at least one player, each of said banker and player having a position, said game having a game outcome, said method comprising the steps of:

(a) providing a random number generator for use in determining which of said positions first receives cards, said random number generator having a position outcome;

(b) allowing said player to place a wager on said game outcome;

(c) allowing said player to place a wager on said position outcome;

(d) activating said random number generator to provide said position outcome;

(e) making an appropriate payout to said player wagering on said position outcome based on said position outcome;

(f) dealing a predetermined number of cards to said player to form a player complete hand and to said banker to form a banker complete hand;

(g) allowing said player to divide said player complete hand into a player low hand and a player high hand;

(h) allowing said banker to divide said banker complete hand into a banker low hand and a banker high hand, said banker low hand having the same number of cards as said player low hand;

(i) comparing said player low hand to said banker low hand and said player high hand to said banker high hand to determine said game outcome; and (j) making an appropriate payout to said player based on said game outcome.

2. The method for playing a Pai Gow poker game of claim 1 wherein said random number generator is a plurality of dice.

3. The method for playing a Pai Gow poker game of claim 1 wherein said random number generator is a digital electronic number generator.

* * * * *